US006065225A

United States Patent [19]

Herre

[11] Patent Number: 6,065,225

[45] Date of Patent: May 23, 2000

[54] METHOD AND DEVICE FOR DRYING WORKPIECES PROVIDED WITH A SURFACE COATING

[75] Inventor: Waldemar Herre, Steinheim, Germany

[73] Assignee: LTG Holding GmbH, Stuttgart, Germany

[21] Appl. No.: 09/111,851

[22] Filed: Jul. 8, 1998

[30] Foreign Application Priority Data

Jul. 8, 1997 [DE] Germany ..... 197 29 147

[51] Int. Cl.[7] ..... F26B 3/00

[52] U.S. Cl. ..... 34/463

[58] Field of Search ..... 34/380, 414, 422, 34/429, 444, 459, 463, 465, 487, 621, 640, 641, 642, 649, 651, 652, 653, 655; 118/325, 415; 427/315, 377, 420; 226/95, 97, 196.1; 198/612, 468.11, 468.2

[56] References Cited

U.S. PATENT DOCUMENTS

| | | | |
|---|---|---|---|
| 1,399,415 | 12/1921 | Taliaferro . | |
| 1,779,622 | 10/1930 | Dreffein . | |
| 2,039,429 | 5/1936 | Lydon . | |
| 2,198,362 | 4/1940 | Bailey . | |
| 2,817,506 | 12/1957 | Albright . | |
| 2,950,098 | 8/1960 | Ruff . | |
| 3,947,235 | 3/1976 | Bornert | 432/2 |
| 4,058,908 | 11/1977 | Weber | 34/189 X |
| 5,396,716 | 3/1995 | Smart et al. | 34/464 |

FOREIGN PATENT DOCUMENTS

| | | |
|---|---|---|
| 2338871 | 2/1975 | Germany . |
| 2454091 | 5/1975 | Germany . |
| 4019741 | 1/1992 | Germany . |
| 579187 | 7/1946 | United Kingdom . |

OTHER PUBLICATIONS

Patent Abstracts of Japan, vol. 14, No. 373 (M–1009), Aug. 13, 1990 and JP 02 133791 A, May 22, 1990.

*Primary Examiner*—Stephen Gravini
*Attorney, Agent, or Firm*—Ostrolenk, Faber, Gerb & Soffen, LLP

[57] ABSTRACT

A method and a device for drying workpieces that have been provided with a fresh surface coating and are conveyed through a drying zone in a housing wherein hot air is applied to the workpieces to dry them. At least a fraction of the walls and/or built in component in the region of the housing to which the workpieces are conveyed have hot air applied to them for preventing formation of condensate. A hot air barrier may be provided at the inlet or the outlet of the drying zone. A material for bonding and storing liquid may be provided on at least a fraction of the walls and/or built in components.

19 Claims, 3 Drawing Sheets

METHOD AND DEVICE FOR DRYING WORKPIECES PROVIDED WITH A SURFACE COATING

BACKGROUND OF THE INVENTION

The present invention relates to a method for drying workpieces, in particular metal sheets, provided with a fresh surface coating, wherein the workpieces are conveyed through a drying zone in a housing where the work-pieces have hot air applied to them in the process.

After they have been printed and/or coated, metal sheets are transported through a drying system by a workpiece conveyor device including a continuous belt. In the drying system, the metal sheets are held by the retaining frame of the continuous belt and are exposed to a hot air flow as they are transported through the drying zone in the process. At the end of the drying zone, the metal sheets have a solidified surface coating. Then they are removed from the workpiece conveyor device and are deposited, for example automatically, in a stack. The known method has a risk of condensate forming on the walls, ceilings or built in components of the housed drying zone. The condensate is mostly viscous. Upon accumulation of a sufficient quantity, the condensate can run down or drip off, causing the freshly coated metal sheets moving in the region to become contaminated and therefore unusable. Since the contamination occurs mostly only on individual metal sheets, it is impossible to ensure continuous production because of the laborious undertaking of separating the unusable workpieces. These contamination problem occur, in particular, when organosols, phenolic resins or special white pigmented coatings are used. The design of the dryer and the setting of its air budget also influence the problem of contamination. High degrees of contamination are to be expected given the short drying path in a double coating line.

SUMMARY OF THE INVENTION

It is therefore the object of the invention to create a method for drying workpieces that have been provided with a fresh surface coating, by means which avoid contamination by condensate that runs down or drips off a surface.

According to the invention, at least a fraction of the walls situated in the region of the conveying zone and/or of the built-in components of the drying zone likewise has or have hot air applied. The surfaces and/or built-in components in the interior of the drying zone, which are sites that are predestined for condensate precipitation, are heated by hot air. Condensation on them is very largely avoided, but is at least decisively reduced. The invention represents a special feature, inside a space, specifically the housed drying zone. In addition to hot air that is blown in any case to dry the surface coating of the workpieces, hot air is used to eliminate the contamination problem. Surfaces that are prone to formation of condensate are purposely brought to a higher temperature level by additional application of hot air. As a result, condensation does not occur, or occurs only to a very slight extent. Since the hot air preventing the condensation is introduced into the space of the drying zone, this measure also assists the actual drying of the surface coating, ensuring high efficiency overall, since the energy for preventing condensation is simultaneously available as drying energy for the workpieces. The hot air that is fed to the surfaces that are prone to condensate formation preferably forms a veil of hot air or a layer of hot air, that is, it sweeps over the surfaces. This makes it possible to treat relatively large regions with a relatively small amount of hot air. The veil of hot air further reduces the access of fresh concentrated return air to the walls, which would form condensate.

In one development, the hot air that is used to heat the walls/built in components is branched off from a hot air stream that is provided for being applied to the workpieces. Consequently, no additional hot air preparation is needed since it is possible to use a fraction of the hot air which is available for drying the surface coating. Considering the flow characteristic of the hot air that is used for drying the surface coating, this forms a primary return air system for heating the workpieces. A secondary hot air return air system is superimposed and this serves to heat the surfaces prone to condensate. It is as if a type of bypass system has been created relative to the primary return air system.

In another development, the hot air is fed obliquely or parallel to the surfaces of the walls/built-in components that are prone to condensate formation. Veils of hot air and layers of hot air are formed optimally in this way. Feeding at a very acute angle or even parallel induces the Coanda effect, that is, a small impulse of the hot air suffices to move the latter in a very far reaching fashion along the surface that is prone to condensate formation.

The invention also relates to a device for drying workpieces, particularly metal sheets, that have been provided with a fresh surface coating. The drying device has a workpiece conveyor which traverses a hot air drying zone in a housing. At least a fraction of the walls and/or built in components of the drying zone, which are situated in the region of the conveying zone, has hot air applied to it. The hot air is applied in addition to the hot air which is introduced into the drying zone and is applied to the workpieces. This avoids the risk of contamination of the workpieces due to dripping condensate and the risk of contamination of the interior of the drying zone and of the conveyor device, as far as possible.

According to one development, the walls are situated in the region of an exhaust device for the return of the hot air. Consequently, the walls are then purposely heated by a special hot air guidance. As a result, remedial measures are undertaken against the incidence of condensate formation even in the region of the air return, which has a tendency to condensate formation because of low temperature. The return of the hot air comprises both the hot air fraction which was used for workpiece treatment and the residual fraction of the hot air which is used to eliminate the contamination problem.

In the workpiece conveying direction, the device for drying the workpieces preferably has hot air outlet ducts on both sides in the upper region, with hot air nozzles for application to workpieces. An exhaust air duct, which has exhaust air openings, is arranged between the two hot air ducts. This produces a zone of increased proneness to condensate formation along the longitudinal central planes of the dryer. The conveying zone is situated below the above noted zone, that is, the region at risk from contamination. The outside of the exhaust air duct running over the longitudinal extent of the dryer is therefore situated above the conveyor zone and consequently constitutes a surface that is particularly predestined to the dripping of condensate. This outside of the exhaust air duct is provided with a veil of hot air in order to achieve the desired heating. The veil of hot air is taken up by the exhaust air duct in the above mentioned secondary return air system, that is, there is a continuous exchange of air which prevents condensation to the greatest possible extent, or even completely.

According to one development of the invention, at least one side of the exhaust air duct has a supply air duct for feeding the supply air. The exhaust air duct and the supply air duct can abut one another directly and be separated from one another only by means of a parting metal sheet, or it is also possible for there to be spacing between the exhaust air duct and supply air duct. This lateral arrangement of the exhaust air duct relative to the supply air duct is a consequence of the design already mentioned above, in which the exhaust air duct is arranged between the two supply air ducts. A particularly simple embodiment provides the supply air duct with one or more outlet openings from which the hot air is applied to the walls and/or built-in components. It is therefore necessary for the purpose of forming the veil of hot air merely to provide the already existing supply air duct with outlet openings. As an alternative, it is also possible to use outlet nozzles instead of outlet openings.

According to a preferred embodiment of the invention, the outlet openings or outlet nozzles have at least one air guiding device which guides the hot air so that it sweeps over a large area of the surfaces prone to condensate formation.

The supply air duct may project beyond the underside of the exhaust air duct, that is, there is a projecting lateral wall region of the supply air duct. It is possible for the outlet openings or outlet nozzles for the hot air preventing condensation to be arranged in the lateral wall region. Without need for additional measures, it is thereby possible for the hot air to be fed approximately parallel to the outside of the exhaust air duct. The flow direction of the hot air is approximately horizontal and approximately at right angles to the direction of movement of the workpieces. The lateral wall region of the supply air duct, which projects beyond the underside of the exhaust air duct, is suitable, moreover, for fastening air guiding device, particularly an air deflector, there. Consequently, between the underside of the exhaust air duct, which faces the supply air duct, and the air deflector a zone is formed in the form of a gap which extends at least over a portion of the length of the dryer and into which the hot air serving to combat condensate is blown. This produces an optimum flow for forming the veil of hot air, as a relatively low volumetric flow is already sufficient to achieve the desired effect which prevents contamination.

Alternatively or additionally, it is possible to use a material which binds liquid for the purpose of avoiding the contamination of workpieces due to dripping condensate. Consequently, the device for drying workpieces, particularly metal sheets, which are provided with a fresh surface coating, and having a workpiece conveyor device which traverses a hot air drying zone in a housing, has a material which binds liquid or is absorptive and is arranged on/applied at least to the surfaces that are prone to condensate. Fleece or felt, for example, can be used as a material which binds liquid. The materials absorb condensates to store them and thereby prevents their dripping. These materials are preferably arranged in an easily exchangeable fashion, and particularly are disposable parts. The interior of the drying zone is put into a clean state within a very short time by means of a material exchange. Thus, if condensation occurs, it does not cause dripping of the condensate, since this is prevented by the material which binds or stores liquid. The time interval between two cleaning intervals is thereby also advantageously lengthened, enabling the drying device to be used more efficiently.

The surfaces and/or built in components, which are situated in the interior of the drying zone and are prone to the precipitation of condensate, are attached in an easily exchangeable fashion. It is preferable that these surfaces and/or built-in components be fastened in the region of the drying zone in a suspended and/or latching fashion and/or using quickly releasable retaining means. It is thereby possible for these components, particularly wall cladding parts, to be exchanged quickly and easily to be able to operate the drying device without appreciable delay. Once the drying zone is fitted with new wall cladding parts, the removed components can be cleaned, while the drying device is already operating again. If the parts are equipped with the material which binds liquid or is absorptive, the parts can be covered with new material, with the result that they are ready for use again at the next cleaning interval. As an alternative to use of material which binds liquid or is absorptive, it is also possible to use solid, easily fittable wall cladding parts, particularly plates made from sheet metal or plastic, to be able to carry out cleaning work very quickly. These wall cladding parts can be reused after being very easily cleaned.

Equipping the drying zone with material which binds liquid or is absorptive and is preferably easy to exchange, e.g. preferably fleece or felt, is, moreover, a measure which is easy to carry out and yet is effective, in order to avoid contamination of workpieces during a drying operation. Moreover, existing drying devices may be retrofitted with a fleece or felt in the region of their drying zone without great technical outlay.

The invention also relates to a device for drying workpieces, in particular metal sheets, that have provided with a fresh surface coating. The device has a workpiece conveyor device which traverses a hot air drying zone in a housing. At least one hot barrier air curtain is produced in the region of the inlet and/or outlet of the drying zone. As far as possible, this prevents entrance of ambient air into the interior of the drying zone, by precluding the entrance of cold air to the greatest possible extent. Since the incoming cold air promotes condensation, the barrier air curtain constitutes a reliable measure for avoiding condensate.

All the above measures, that is heating with additional hot air, using a material which binds liquid, and forming a barrier air curtain at the inlet and/or outlet of the tunnel like hot air drying zone can be taken individually or also in any combination in order to avoid or minimize condensation. In particular, these measures may be carried out only in the region of the tunnel inlet or the region of the tunnel outlet, for example in each case over a length of three meters, since condensate formation is greatest in these regions. Further, in the interior of the tunnel like, hot air drying zone, the high and uniformly distributed temperatures that prevail render taking such measures superfluous. In addition to the above mentioned measures, it is also possible to provide the tunnel inlet and/or the tunnel outlet with an exhaust hood, for creating above the tunnel opening or the tunnel outlet a zone which prevents direct entrance of the relatively cold room air at the site where the device is set up into the hot air drying zone. Furthermore, it is particularly favorable to blow hot air out upward in the lower region of the tunnel inlet or of the tunnel outlet, in order to create the above mentioned barrier air curtain. Given the presence of the hood, the hot air contributes to the fact that the air flow of the barrier air curtain is stable and can be removed in a defined fashion in accordance with the recirculating air principle.

Other features and advantages of the present invention will become apparent from the following description of the invention which refers to the accompanying drawings.

DETAILED DESCRIPTION OF THE INVENTION

Figure 1:
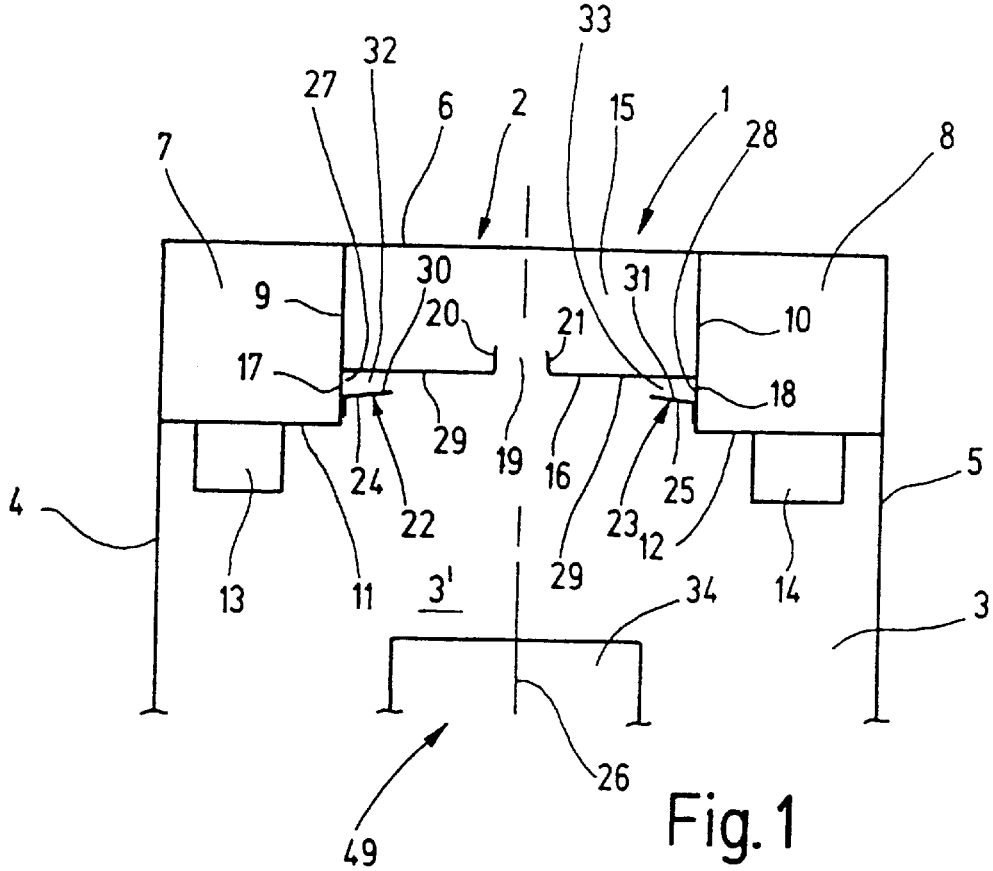
FIG. 1 shows a diagrammatic cross-sectional view through the upper region of a hot air drying zone of a device for drying workpieces that are provided with a fresh surface coating.

FIG. 1 shows a diagrammatic cross section through a device 1 for drying workpieces, in particular metal sheets, that have been provided with a fresh surface coating. The device 1, which is constructed as a dryer 2, has a hot air drying zone 3 in a housing which has side walls 4 and 5 and a ceiling 6. Supply air ducts 7 and 8 are arranged in the corner region between the side wall 4 and the ceiling 6 or between the side wall 5 and the ceiling 6. They extend in the direction of the longitudinal extent of the dryer 2. Each supply air duct 7, 8 has a vertical side wall 9 and 10, respectively, which extend parallel and are spaced from the associated side walls 4 and 5, respectively. Furthermore, each supply air duct 7, 8 has a respective floor 11, 12 which is penetrated by hot air outlet nozzles 13 and 14, respectively, which are arranged in a row over the longitudinal extent of the dryer and situated spaced from one another. An exhaust air duct 15 is situated between the side walls 9 and 10 and has a ceiling which is formed by a part of the ceiling 6 and has side walls which are formed by sections of the side walls 9 and 10. A floor 16 of the exhaust air duct 15 extends parallel to the ceiling 6. A side wall region 17, 18 of the side wall 9 or 10 projects above the bottom of the duct. In each case, a step is constructed relative to the floor 11 and 12, respectively. An exhaust slot 19 which is constructed in the central region of the floor 16 of the exhaust air duct 15, is bounded by upwardly pointing edge regions 20 and 21 of the floor 16. The two edge regions 20 and 21 extend a short distance into the interior of the exhaust air duct 15.

Figure 2:
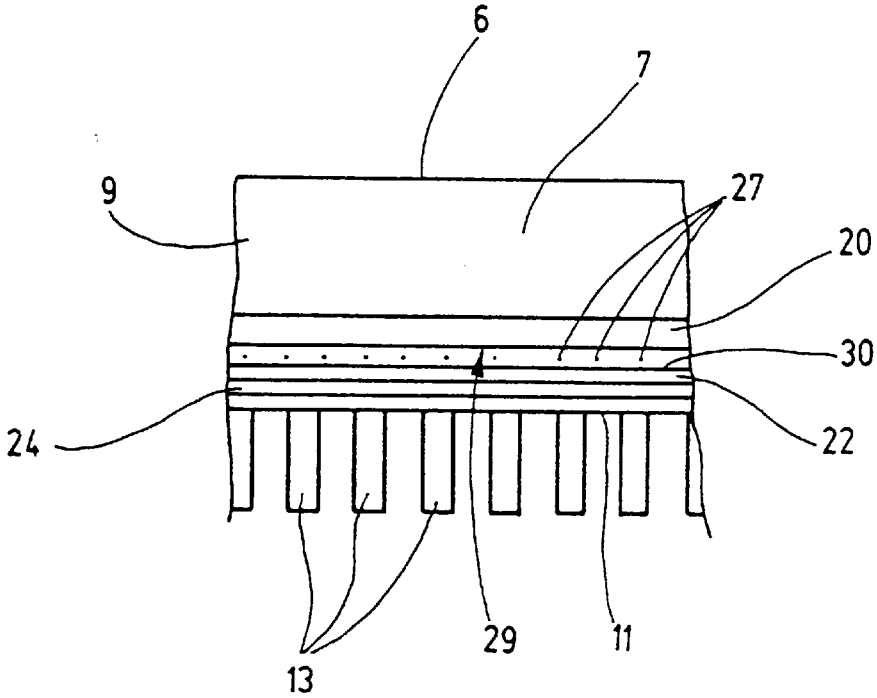
FIG. 2 shows a plan view of a longitudinal lateral section of a supply air duct located in the hot air drying zone.

Air guiding devices 22 and 23 are arranged at a spacing from the floor 16 on the side wall region 17 and 18, projecting beyond the exhaust air duct 15, of the supply air ducts 7 and 8. Each air guiding device 22 and 23 is formed by an angle plate 24 and 25, respectively. One limb of the respective angle plate 24, 25 is fastened to the associated side wall region 17, 18, and the second free limb extends inclined in the direction of the central plane 26 relative to the floor 16 in such a way that the respective free end diverges towards the floor 16. The side wall regions 17 and 18 are penetrated by outlet openings 27, 28, which are arranged distributed in a row over the longitudinal extent of the dryer 2. The outlet openings 27, 28 are located between the underside 29 of the floor 16 and the respective inside 30, 31 of the free limb of the air guiding device 22 or 23 (FIG. 2). This forms gap zones 32 and 33 which guide hot air streams emerging from the outlet openings 27 and 28 along the underside 29 of the floor 16 of the exhaust air duct 15, forming veils of hot air there.

FIG. 1 shows workpieces 34 in the form of metal sheets with a fresh surface coating located below the exhaust air duct 15. The workpieces are transported, supported by retaining frames (not shown) in the direction of the longitudinal extent of the dryer 2 by a workpiece conveyor (not represented). In other words, below the exhaust air duct 15, the workpieces 34 are guided through the drying zone 3 in a conveying zone 3' by means of a conveyor device that operates like a continuous belt.

The following method of operation functioning results. Hot air supplied by the supply air ducts 7 and 8 leaves the hot air outlet nozzles 13 and 14 and is blown onto the workpieces 34 transported through the dryer 2, which dries the fresh surface coating of the workpieces 34. The two hot air streams leaving the hot air outlet nozzles 13 and 14 unite in the drying zone and are removed from that zone via the exhaust slot 19 and the exhaust air duct 15. After appropriate treatment, using the recirculating air principle, the hot air is passed once again into the supply air ducts 7 and 8. A primary recirculating air system is created thereby. A portion of the hot air that is fed by the supply air ducts 7 and 8 leaves the outlet openings 27 and 28 of the side wall regions 17 and 18 and passes into the respective gap zone 32 or 33. The air guiding devices 22 and 23 ensures that a veil of hot air forms on the underside 29 of the floor 16 of the exhaust air duct 15, which heats the underside 29. The hot air forming the veil of hot air is likewise removed through the exhaust slot 19.

The heating of the underside 29 of the floor 16 prevents precipitation of condensate in this region which could drip onto the freshly coated workpieces 34.

Figure 3:
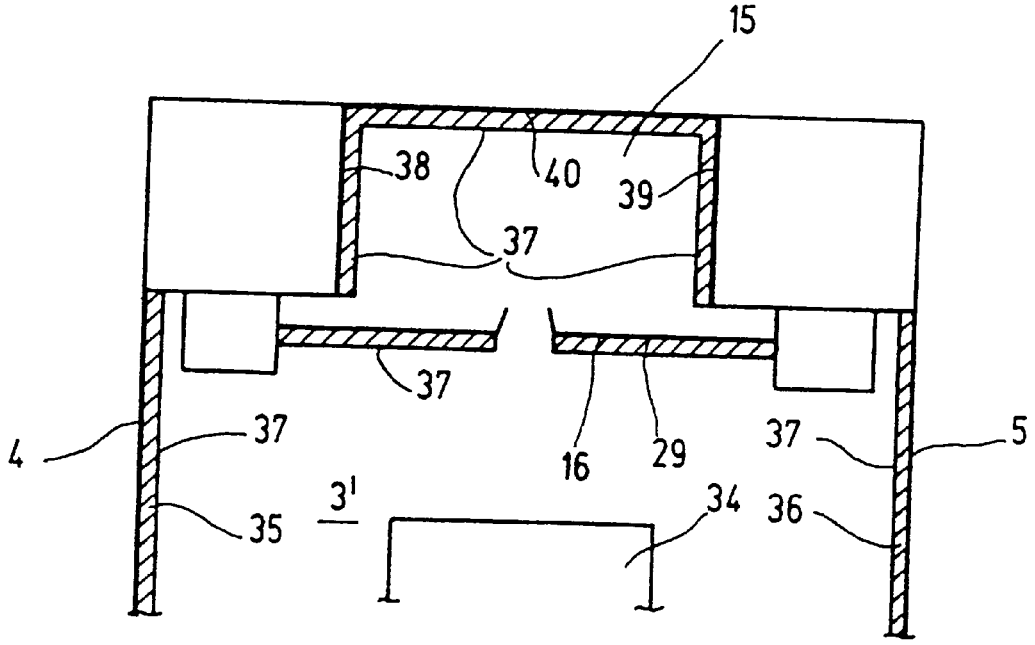
FIG. 3 is a view corresponding to FIG. 1, showing surfaces that are prone to condensate which do not, however, have hot air applied to them, but carry a material which stores liquid.

FIG. 3 shows an arrangement which corresponds to that of FIG. 1, and only the differences between the two exemplary embodiments of FIGS. 1 and 3 are discussed below. The insides 35 and 36 of the side walls 4 and 5 are covered with a material 37 which binds or stores liquid for example, fleece or felt. The underside 29 of the floor 16 of the exhaust air duct 15 is also covered with the material 37, as are the insides 38, 39 and 40 of the exhaust air duct 15. The material 37 which stores liquid has the property of possibly absorbing condensate produced so as to store it, preventing it from dripping or running down. In a departure from the embodiment of FIG. 1, in the embodiment of FIG. 3 the floor 16 of the exhaust air duct 15 is lower, enlarging the cross section of the exhaust air duct 15.

Figure 4:
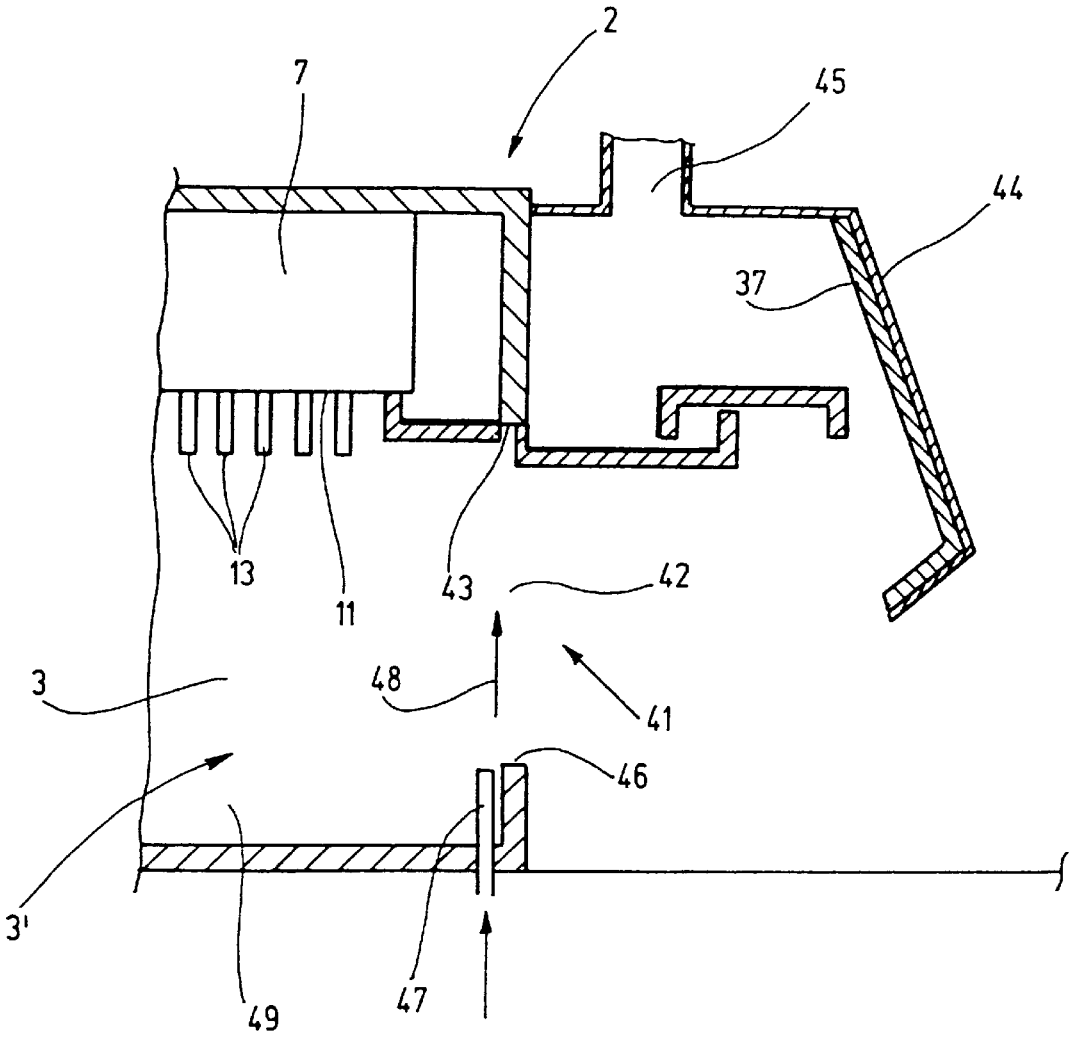
FIG. 4 shows a side view of the inlet of the hot air drying zone of the device constructed as a dryer, the inlet opening being overhung by a hood, and hot air outlet nozzles being provided in the lower region of the inlet opening in order to create a barrier air curtain.

FIG. 4 shows a side view of the inlet 41 of the device in FIG. 1. The inlet 41 is formed by an inlet opening 42. The upper edge 43 of the inlet opening 42 is overhung by a hood 44 which has an exhaust air duct 45. The lower edge 46 of the inlet opening 42 has hot air outlet nozzles 47 oriented such that, as shown by the arrow 48, a hot barrier air curtain flows from bottom to top in the inlet opening 42. The hood 44 and/or the barrier air curtain prevent cool room air from passing from the room in which the dryer 2 is set up into the inlet region of the drying zone 3 which would intensify the formation of condensate. This penetration of the cool room air would be critical, in particular, in the region of the lower edge 46 of the inlet opening 42. However, this penetration is prevented as far as possible owing to the hot air outlet nozzles 47 arranged there.

For the rest, it is possible to provide material 37 which binds liquid on the inner walls of the hood 44. In particular, this material is fitted in the upper region of the inside of the hood 44 on the ceiling or on the side walls.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for drying workpieces which have been provided with a fresh surface coating, the method comprising:

conveying the workpieces through a housing having a drying zone and having walls in the drying zone;

applying hot air to the workpieces passing through the drying zone; and applying hot air to at least part of the walls in the drying zone and to built in components of the housing in the drying zone for eliminating condensate thereon.

2. The method of claim 1, wherein a hot air stream is provided for applying hot air to the workpieces; and branching off the hot air stream for heating the walls and the built in components at the housing.

3. The method of claim 1, further comprising introducing the hot air obliquely or parallel to the surface of the walls of the drying zone or the built in components.

4. A device for drying workpieces, that have been provided with a fresh surface coating, comprising:

a housing having a hot air drying zone within the housing;

the housing including walls that are within and/or built in components in the drying zone;

a workpiece conveyor for conveying workpieces to be dried through the hot air drying zone;

first hot air outlets in the region of the drying zone for applying hot air to the workpieces and second hot air outlets for applying hot air to at least a fraction of the housing walls and/or the built in components in the drying zone.

5. The device of claim 4, further comprising an exhaust air device for returning hot air and located in the region of the walls being dried.

6. The device of claim 5, wherein the exhaust air device comprises an exhaust air duct in the housing, the exhaust air duct having an underside and the fraction of the housing walls being at the underside of the exhaust air duct.

7. The device of claim 6, wherein the exhaust air device is located above the workpieces being conveyed in the hot air drying zone.

8. The device of claim 6, wherein the exhaust air duct extends in the conveying direction of the workpiece.

9. The device of claim 8, further comprising a supply air duct for feeding supply air to the exhaust air duct.

10. The device of claim 9, wherein the supply air duct has several outlet openings along the conveying direction of the workpiece from which hot air exits and is directed to be applied to the walls and/or built in components in the housing.

11. The device of claim 10, further comprising air guide devices at the outlet openings for guiding the air from the outlet openings along the walls or built in components.

12. The device of claim 10, wherein the supply air duct projects beyond the underside of the exhaust air duct, the supply air duct has a projecting side wall region and the air outlet openings are in the projecting side wall region.

13. The device of claim 12, further comprising air guiding devices at the outlet openings for guiding the air from the outlet openings along the walls or built in components; the air guiding devices being fastened to the projecting side wall region of the supply air duct.

14. The device of claim 13, wherein the air guiding devices comprises air deflector plates.

15. The device of claim 14, wherein each air deflector plate is spaced from the underside of the exhaust air duct to define a direct passage thereat.

16. A device for drying workpieces, that have been provided with a fresh surface coating, comprising:

a housing having a hot air drying zone housed within the housing;

the housing including walls that are within and/or built in components within the drying zone;

a workpiece conveyor for conveying workpieces to be dried through the hot air drying zone;

hot air outlets in the region of the drying zone for applying hot air to the workpieces;

at least a fraction of the walls and/or the built in components of the device in the drying zone carry a material which binds and stores liquid.

17. The device of claim 16, wherein the material is fleece or felt.

18. The device of claim 4, further comprising nozzles for defining a hot air barrier air curtain at at least one of the inlet and outlet of the drying zone.

19. The device of claim 4, further comprising at least a fraction of the walls and/or the built in components in the drying zone being provided with a material which binds and stores liquid.

* * * * *

UNITED STATES PATENT AND TRADEMARK OFFICE

CERTIFICATE OF CORRECTION

PATENT NO. : 6,065,225
DATED : May 23, 2000
INVENTOR(S) : Waldemar Herre et al.

It is certified that error appears in the above-identified patent and that said Letters Patent is hereby corrected as shown below:

[19] Herre et al.

[75] Inventors: Waldemar Herre, Steinheim, Germany
Theo Finkbeiner, Ditzingen, Germany
Franz Meschenmoser, Neckarweihingen, Germany Signed and Sealed this Twenty-eighth Day of August, 2001

*Attest:*

Nicholas P. Godici

*Attesting Officer*

NICHOLAS P. GODICI
*Acting Director of the United States Patent and Trademark Office*